US011454240B2

(12) United States Patent
Hu et al.

(10) Patent No.: US 11,454,240 B2
(45) Date of Patent: Sep. 27, 2022

(54) PUMP BODY ASSEMBLY AND COMPRESSOR

(71) Applicant: Gree Electric Appliances, Inc. of Zhuhai, Guangdong (CN)

(72) Inventors: Yusheng Hu, Guangdong (CN); Huijun Wei, Guangdong (CN); Jia Xu, Guangdong (CN); Fayou Luo, Guangdong (CN); Pengkai Wan, Guangdong (CN); Fei Wu, Guangdong (CN); Rongting Zhang, Guangdong (CN); Zhiming Wen, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/057,730

(22) PCT Filed: Dec. 12, 2018

(86) PCT No.: PCT/CN2018/120666
§ 371 (c)(1),
(2) Date: Nov. 23, 2020

(87) PCT Pub. No.: WO2020/042432
PCT Pub. Date: Mar. 5, 2020

(65) Prior Publication Data

US 2021/0207602 A1 Jul. 8, 2021

(30) Foreign Application Priority Data

Aug. 31, 2018 (CN) ..... 201811014368.8

(51) Int. Cl.
*F01C 21/04* (2006.01)
*F03C 2/00* (2006.01)
(Continued)

(52) U.S. Cl.
CPC ..... *F04C 29/02* (2013.01); *F04C 18/344* (2013.01); *F04C 29/023* (2013.01); *F04C 2240/56* (2013.01)

(58) Field of Classification Search
CPC ..... F04C 18/344; F04C 18/3441; F04C 18/3446; F04C 3/02; F04C 29/02;
(Continued)

(56) References Cited

U.S. PATENT DOCUMENTS 3,082,937 A * 3/1963 Tucker ..... F01C 21/0809 418/63
4,231,727 A 11/1980 Buchholz et al.
(Continued)

FOREIGN PATENT DOCUMENTS

CN 106168216 A 11/2016
CN 107524600 A 12/2017
(Continued)

OTHER PUBLICATIONS

International Search Report (ISR), Written Opinion (WO), or International Preliminary Report on Patentability (IPRP) for corresponding PCT Application No. PCT/CN2018/120666.
(Continued)

*Primary Examiner* — Theresa Trieu
(74) *Attorney, Agent, or Firm* — The Webb Law Firm

(57) ABSTRACT

A pump body assembly and a compressor are provided. The pump body includes: a spindle, wherein the spindle has a sliding vane chute, a back pressure oil cavity being at least a part of an oil passage is located at a tail end of the sliding vane chute, an oil outlet of the back pressure oil cavity is located at the top of the back pressure oil cavity, and a position of the oil inlet of the back pressure oil cavity is lower than that of an oil outlet of the back pressure oil cavity such that a lubrication medium enters the back pressure oil
(Continued)

cavity through the oil inlet of the back pressure oil cavity and fills up the back pressure oil cavity and flows out from the top of the back pressure oil cavity.

10 Claims, 11 Drawing Sheets

(51) Int. Cl.

| | |
|---|---|
| ***F03C 4/00*** | (2006.01) |
| ***F04C 2/00*** | (2006.01) |
| ***F04C 29/02*** | (2006.01) |
| ***F04C 18/344*** | (2006.01) |

(58) Field of Classification Search
CPC ..... F04C 29/023; F04C 2240/56; F04C 2240/603; F01C 21/0809
See application file for complete search history.

(56) References Cited

U.S. PATENT DOCUMENTS

| | | | | |
|---|---|---|---|---|
| 9,458,849 | B2 * | 10/2016 | Sekiya | F01C 21/0809 |
| 2014/0294642 | A1 | 10/2014 | Sekiya et al. | |

FOREIGN PATENT DOCUMENTS

| | | | | | |
|---|---|---|---|---|---|
| CN | 207349076 | U | * | 5/2018 | F01C 21/0809 |
| CN | 207500118 | U | | 6/2018 | |
| CN | 108930651 | A | | 12/2018 | |
| CN | 208749547 | U | * | 4/2019 | F01C 21/0809 |
| DE | 2631152 | A1 | | 1/1978 | |
| JP | 2009228520 | A | | 10/2009 | |
| JP | 2011247091 | A | * | 12/2011 | F04C 18/344 |

OTHER PUBLICATIONS

An Office Action/Search Report for related Application No. EP 18932135.

* cited by examiner

PUMP BODY ASSEMBLY AND COMPRESSOR

CROSS-REFERENCE TO RELATED APPLICATIONS

This application is the United States national phase of International Application No. PCT/CN2018/120666 filed Dec. 12, 2018, and claims priority to Chinese Patent Application No. 201811014368.8 filed Aug. 31, 2018 the disclosures of which are hereby incorporated by reference in their entirety.

BACKGROUND OF THE INVENTION

Field of the Invention

The present disclosure relates to the technical field of a compressor, and in particular, to a pump body assembly and a compressor.

Description of Related Art

Compared with other types of compressors, the sliding vane compressor with advantages such as simple parts, absent eccentric structure, stable torque and small vibration, is applied in a wide range of fields. The sliding vane compressor generally has a plurality of sliding vanes, and its operation principles are as follows: when a spindle rotates, the sliding vanes within the sliding vane chute of the spindle perform complex movement together, and a cavity formed by the front sliding vanes, rear sliding vanes, the spindle and the cylinder continuously changes periodically along with rotation of the spindle so as to achieve compression or expansion. Therefore, the prerequisite for normal operation of the sliding vane compressor is that the head of the sliding vane has to always be closely attached to an inner wall of the cylinder within the entire operation cycle. During operation of the sliding vane compressor, the head of its sliding vane is always subjected to the action of a gas force within the cavity. To allow the sliding vane to project out of the sliding vane chute and closely attach to the inner wall of the cylinder, it is necessary to ensure that the tail of the sliding vane has an action force greater than the gas force to which the head is subjected to. That is, it is necessary to provide a sufficient back pressure to give the sliding vane.

SUMMARY OF THE INVENTION

The present disclosure is to provide a pump body assembly and a compressor to solve the problem of insufficient back pressure of the sliding vane in the related art.

According to one aspect of the present disclosure, a pump body assembly is provided.

The pump body assembly comprises: a spindle, wherein the spindle has a sliding vane chute, a back pressure oil cavity being at least a part of an oil passage is located at a tail end of the sliding vane chute, an oil outlet of the back pressure oil cavity is located at the top of the back pressure oil cavity, and a position of the oil inlet of the back pressure oil cavity is lower than that of an oil outlet of the back pressure oil cavity such that a lubrication medium enters the back pressure oil cavity through the oil inlet of the back pressure oil cavity and fills up the back pressure oil cavity and flows out from the top of the back pressure oil cavity.

In some embodiments, the spindle further has a central oil hole extending upward from the bottom and a radial oil hole communicating with the central oil hole, the central oil hole and the radial oil hole are a part of the oil passage, so that the lubrication medium flows to the back pressure oil cavity through the central oil hole and the radial oil hole.

In some embodiments, a position of the radial oil hole is lower than that of the oil inlet of the back pressure oil cavity, and the pump body assembly also comprises a lower flange, an oil passage structure of the lower flange is provided on a lateral surface of the lower flange facing towards the back pressure oil cavity, the oil hole communicates with the oil inlet of the back pressure oil cavity through the oil passage structure of the lower flange, and the oil passage structure of the lower flange is a part of the oil passage.

In some embodiments, the oil passage structure of the lower flange is a back pressure oil chute of the lower flange provided on the lower flange, wherein the back pressure oil chute of the lower flange is a stepped chute which is deeper along a direction far away from the spindle.

In some embodiments, a projection of the stepped chute on the lower flange are two arc profiles and the arc profile far away from the spindle in the two arc profiles is aligned with the back pressure oil cavity.

In some embodiments, the pump body assembly further comprises: an upper flange, wherein an oil passage structure of the upper flange is provided on a lateral surface of the upper flange facing towards the back pressure oil cavity; a bearing cylinder, having a roller accommodating cavity and a roller arranged within the roller accommodating cavity, the oil outlet of the back pressure oil cavity communicates with the roller accommodating cavity through the oil passage structure of the upper flange, and the oil passage structure of the upper flange and the roller accommodating cavity are a part of the oil passage.

In some embodiments, the oil passage structure of the upper flange comprises: a back pressure oil chute of the upper flange communicating with the oil outlet of the back pressure oil cavity; a radial oil passage hole extending along a radial direction of the upper flange, wherein at least a part of the radial oil passage hole communicates with the back pressure oil chute of the upper flange; a communication hole, through which the roller accommodating cavity communicates with the radial oil passage hole.

In some embodiments, a projection of the back pressure oil chute of the upper flange on the upper flange is an arc profile.

In some embodiments, the oil passage structure of the upper flange comprises an oil distribution chute, wherein the back pressure oil chute of the upper flange communicates with the inner wall of the upper flange through the oil distribution chute, and there is a gap between the inner wall of the upper flange and the spindle, such that the lubrication medium flows into the gap through the back pressure oil chute of the upper flange and the oil distribution chute.

In some embodiments, a ratio of the cross-sectional area of the oil distribution chute to that of the radial oil passage hole is 3:7.

In some embodiments, the pump body assembly further comprises a lower flange, wherein an oil outlet chute is provided on a lateral surface of the lower flange facing towards the back pressure oil cavity, the bottom of the roller accommodating cavity communicates with the oil outlet chute, and the oil outlet chute extends to an edge of the lower flange, wherein the oil outlet chute is a part of the oil passage.

In some embodiments, the pump body assembly further comprises a lower flange having an axially penetrating oil drain hole, wherein the bottom of the roller accommodating cavity communicates with the top of the oil drain hole, and the oil drain hole is a part of the oil passage.

In some embodiments, the pump body assembly further comprises a lower flange, wherein an oil drain communication chute is provided on a lateral surface of the lower flange facing towards the back pressure oil cavity; the bearing cylinder comprises: an axial oil drain channel, wherein the bottom of the roller accommodating cavity communicates with the bottom of the axial oil drain channel through the oil drain communication chute; a radial oil drain passage, wherein the top of the axial oil drain passage communicates with an outer circumferential surface of the bearing cylinder through the radial oil drain passage, and the axial oil drain passage and the radial oil drain passage are part of the oil passage.

According to another aspect of the present disclosure, a compressor is provided. The compressor comprises the above-described pump body assembly.

By applying the technical solution of the present disclosure, the pump body assembly comprises a spindle having a sliding vane chute, wherein a tail end of the sliding vane chute is a back pressure oil cavity which is at least a part of the oil passage, and an oil outlet of the back pressure oil cavity is located at the top of the back pressure oil cavity. Moreover, the position of an oil inlet of the back pressure oil cavity is lower than that of the oil outlet of the back pressure oil cavity, so that a lubrication medium enters the back pressure oil cavity through the oil inlet of the back pressure oil cavity and fills up the back pressure oil cavity before flowing out from the top of the back pressure oil cavity.

Since the back pressure oil cavity is at the tail end of the sliding vane chute, a lubrication medium is injected into the back pressure oil cavity so as to provide a back pressure for the sliding vane within the sliding vane chute. In addition, as the position of the oil inlet of the back pressure oil cavity is lower than that of the oil outlet of the back pressure oil cavity, when the lubrication medium flows into the back pressure oil cavity, it is possible to effectively ensure that the back pressure oil cavity is filled up to provide sufficient back pressure for the sliding vane, thereby ensuring that the head of the sliding vane is always closely attached to the inner wall of the bearing cylinder, reducing the leakage problem of the head of the sliding vane, and avoiding the risk that the sliding vane is easily retracted and disengaged from the inner wall of the cylinder. In this way, it is possible to effectively avoid that the head of the sliding vane is disengaged from the bearing cylinder, which causes repeated collisions between the sliding vane and the bearing cylinder and increases the noise and vibration of the pump body assembly, thereby affecting the reliability of the sliding vane and the pump body assembly. In addition, during the process of flowing through the back pressure oil cavity, the lubrication medium produces a favorable lubrication effect on the sliding vane chute, and fully takes away the heat produced by each component, which is favorable for improving the stability of the pump body assembly.

BRIEF DESCRIPTION OF THE DRAWINGS

The accompanying drawings of the specification constituting a part of the present application are intended to provide an understanding of the present disclosure. The exemplary embodiments of the present disclosure and their descriptions which are used to explain the present disclosure, do not constitute a limitation of the present disclosure. In the accompanying drawings.

DETAILED DESCRIPTION OF THE INVENTION

Figure 1:
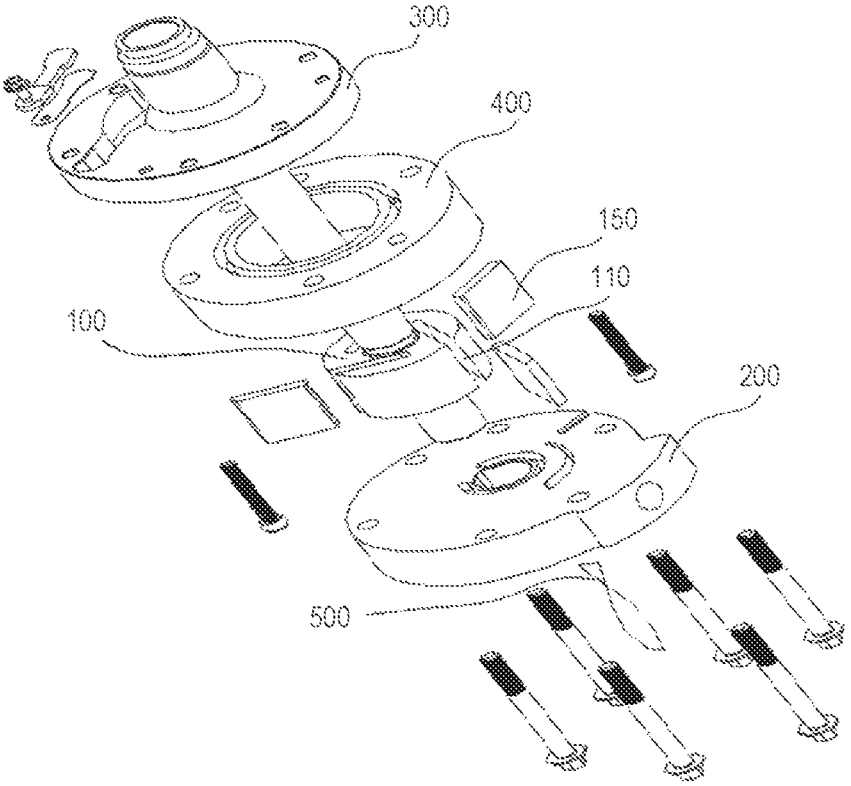
FIG. 1 shows an exploded view of a pump body assembly according to some alternative embodiments of the present disclosure.

It should be noted that, in the case where there is no conflict, the embodiments in the present application and the features in the embodiments are combined with each other.

The present disclosure will be described in detail below with reference to the accompanying drawings and in conjunction with the embodiments.

It should be noted that, unless otherwise specified, all the technical and scientific terms used in the present application have the same meaning as commonly understood by those of ordinary skill in the technical field to which the present application belongs.

In the present disclosure, in the case there is no explanation to the contrary, the orientation words used such as "up, down, top, bottom" are usually in terms of the directions shown in the accompanying drawings, or in terms of the components themselves in a vertical, perpendicular or gravitational direction. Similarly, for ease of understanding and description, the terms "inner and outer" refer to the interior and exterior relative to the contour of each component itself, but the above-described orientation words are not intended to limit the present disclosure.

In order to solve the problem of insufficient back pressure of the sliding vane in the related art, the present disclosure provides a pump body assembly and a compressor. Wherein, the compressor comprises the pump body assembly described below.

Embodiments of the First Group

As shown in FIGS. 1 to 12, the pump body assembly comprises a spindle 100 having a sliding vane chute 110, wherein a tail end of the sliding vane chute 110 is a back pressure oil cavity 120 which is at least a part of the oil passage 160, and the oil outlet 121 of the back pressure oil cavity is located at the top of the back pressure oil cavity 120. Moreover, the position of the oil inlet 122 of the back pressure oil cavity is lower than that of the oil outlet 121 of the back pressure oil cavity, so that the lubrication medium enters the back pressure oil cavity 120 through the oil inlet 122 of the back pressure oil cavity, and fills up the back pressure oil cavity 120 before flowing out from the top of the back pressure oil cavity 120.

Since the back pressure oil cavity 120 is at the tail end of the sliding vane chute 110, a lubrication medium is injected into the back pressure oil cavity 120 so as to provide a back pressure for the sliding vane 150 within the sliding vane chute 110. In addition, as the position of the oil inlet 122 of the back pressure oil cavity is lower than that of the oil outlet 121 of the back pressure oil cavity, when the lubrication medium flows into the back pressure oil cavity 120, it is possible to effectively ensure that the back pressure oil cavity 120 always maintains a filled-up state, so as to provide sufficient back pressure for the sliding vane 150, thereby ensuring that the head of the sliding vane 150 is always closely attached to the inner wall of the bearing cylinder 400, reducing the leakage problem of the sliding vane 150 head and avoiding the risk that the sliding vane 150 is easily retracted or disengaged from the inner wall of the cylinder. In this way, it is possible to effectively avoid that the head of the sliding vane 150 is disengaged from the bearing cylinder 400, which causes repeated collisions between the sliding vane 150 and the bearing cylinder 400 and increases the noise and vibration of the pump body assembly, thereby affecting the reliability of the sliding vane 150 and the pump body assembly. In addition, during the process of flowing through the back pressure oil cavity 120, the lubrication medium produces a favorable lubrication effect on the sliding vane chute 110 and also fully takes away the heat produced by the movement of each friction pair, which is favorable for improving the stability of the pump body assembly.

It should be noted that, due to the presence of the on-way pressure drop and over-compression of the lubrication medium, if the back pressure oil cavity 120 is not filled up with oil, the back pressure at the tail of the sliding vane 150 is not able to satisfy the requirement that the sliding vane is always closely attached to the inner wall of the cylinder during the exhaust phase, and there is a risk that the sliding vane 150 is disengaged, which is likely to cause collision of the sliding vane 150 and affect the reliability of the sliding vane 150 and the noise and vibration of the compressor as a whole. Therefore, to ensure that the back pressure oil cavity 120 is filled up with oil to improve the back pressure of the sliding vane 150 in an exhaust section so as to ensure that the sliding vane 150 is not retreated is critical to the reliability and noise and vibration of the compressor.

Figure 2:
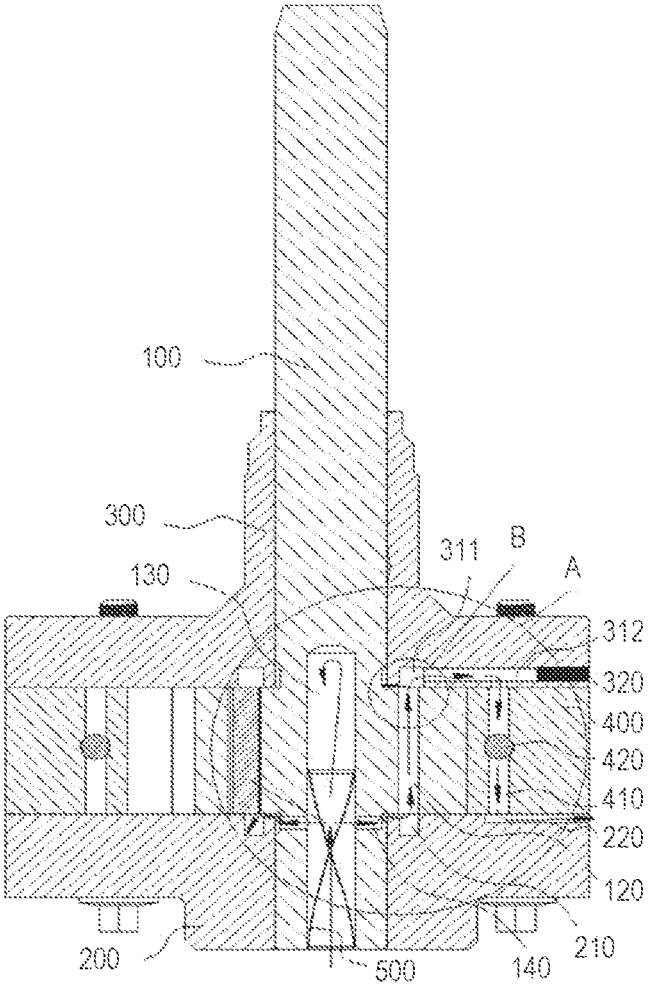
FIG. 2 shows a cross-sectional view of the pump body assembly in FIG. 1.
Figure 3:
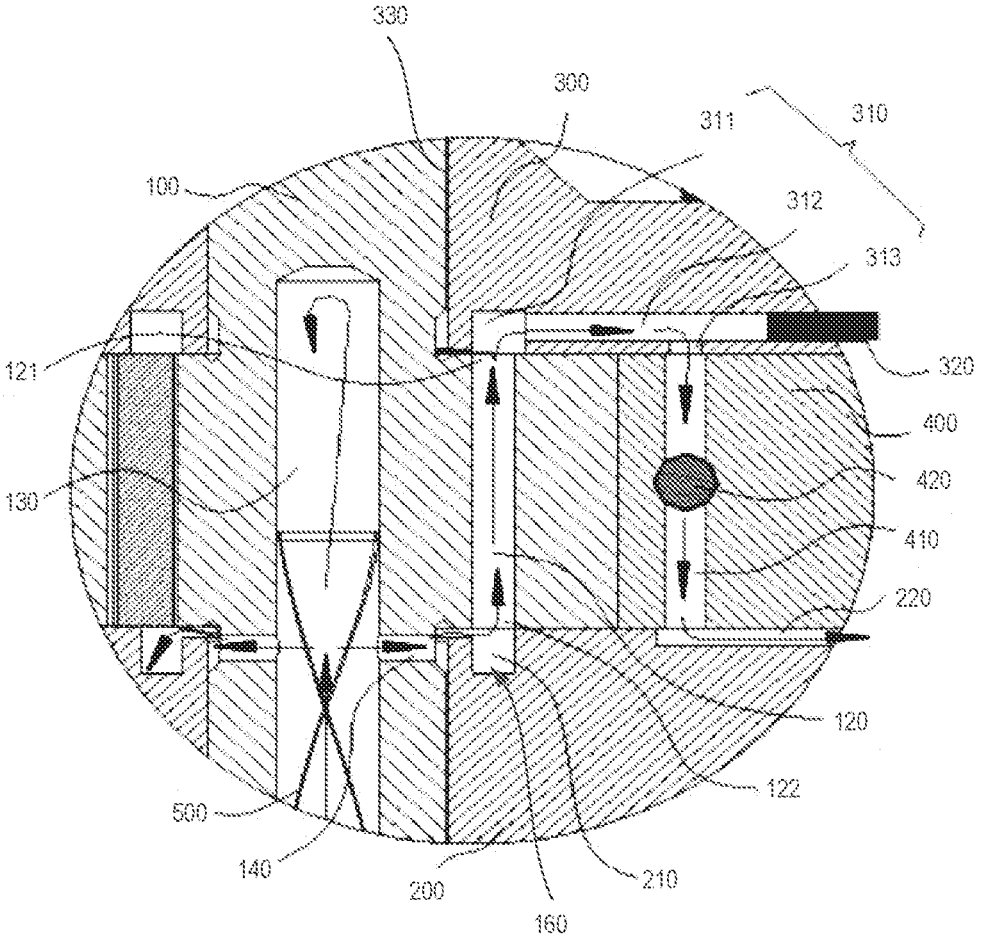
FIG. 3 shows an enlarged view at A in FIG. 2.
Figure 4:
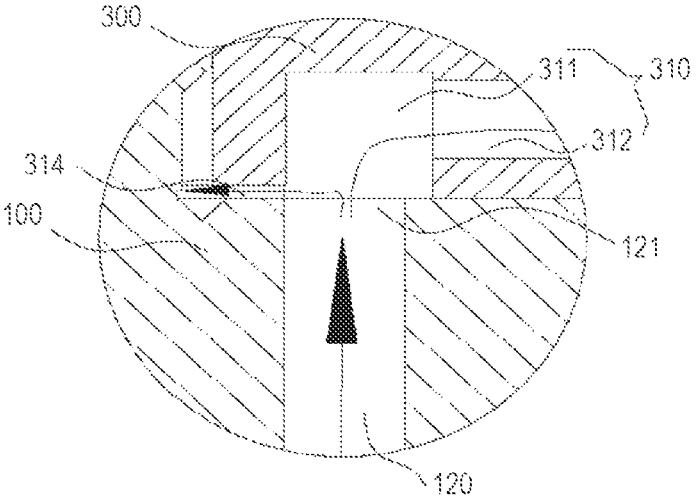
FIG. 4 shows an enlarged view at B in FIG. 2.
Figure 5:
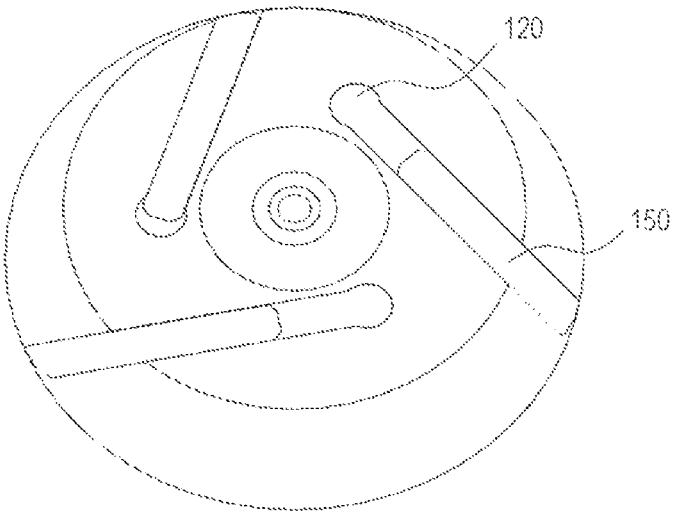
FIG. 5 shows a schematic view of a positional relationship between the spindle and the bearing cylinder in FIG. 1.
Figure 6:
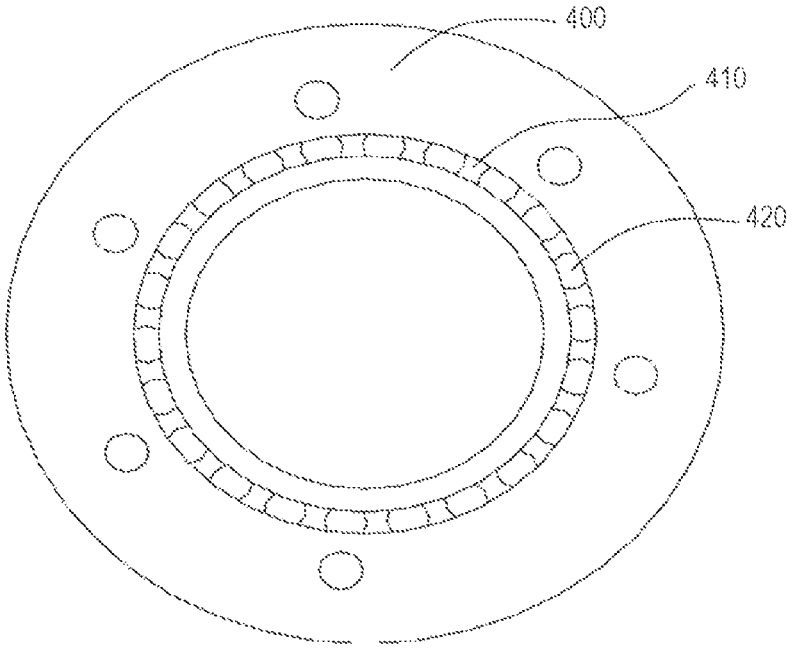
FIG. 6 shows a schematic structural view of the bearing cylinder in FIG. 1.
Figure 7:
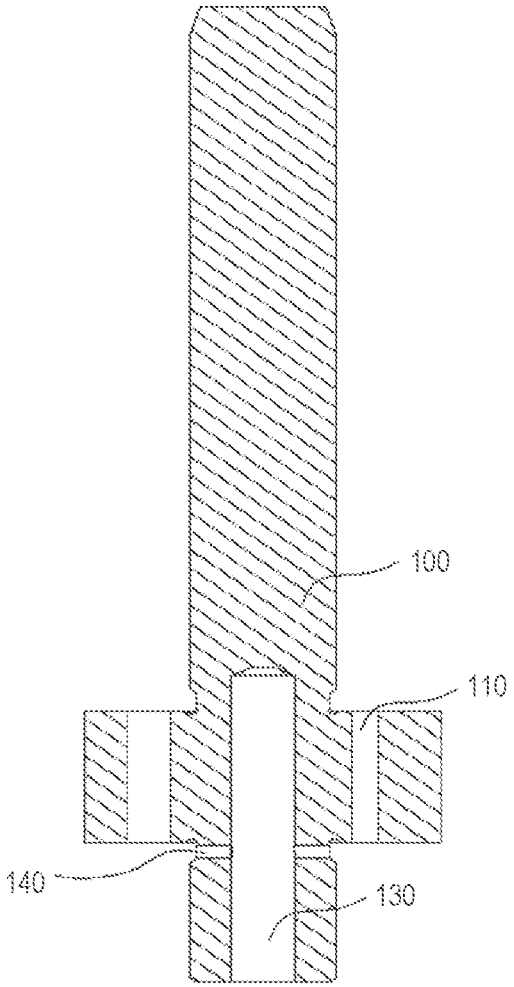
FIG. 7 shows a cross-sectional view of the spindle in FIG. 1.
Figure 8:
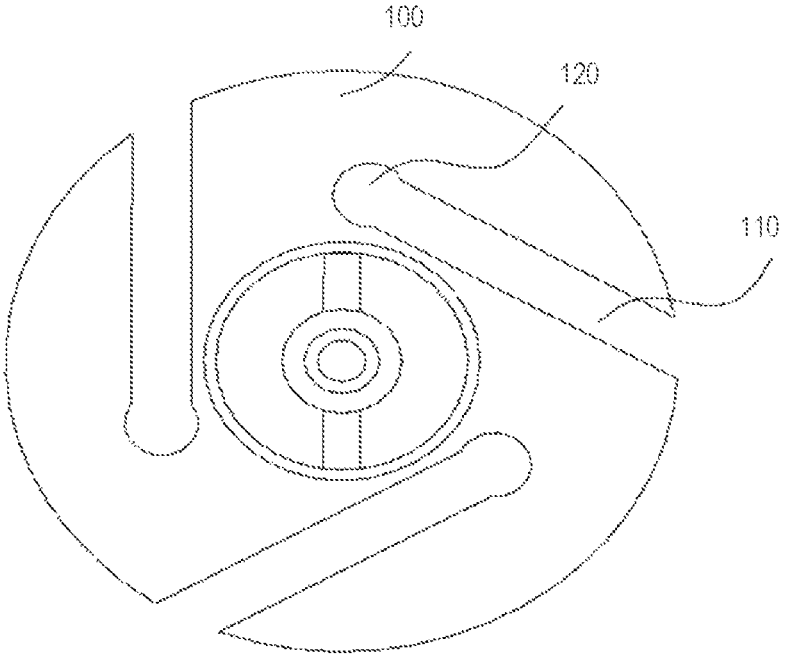
FIG. 8 shows a top view of the spindle in FIG. 1.

As shown in FIGS. 1 to 3, the spindle 100 also has a central oil hole 130 extending upward from the bottom and a radial oil hole 140 communicating with the central oil hole 130. The central oil hole 130 and the radial oil hole 140 constitute a part of the oil passage, and the lubrication medium flows to the back pressure oil cavity 120 through the central oil hole 130 and the radial oil hole 140. The central oil hole 130 is internally provided with an oil deflector 500. When the spindle 100 rotates, the oil deflector 500 assembled within the central oil hole 130 rotates to transport the lubrication medium from the bottom of the central oil hole 130 to the upper part. As the spindle 100 rotates, the lubrication medium within the central oil hole 130 enters the radial oil hole 140 under the action of a centrifugal force, and enters the back pressure oil cavity 120 through the radial oil hole 140.

It should be noted that the central oil hole 130 is a blind hole.

As shown in FIGS. 1 and 2, the position of the radial oil hole 140 is lower than that of the oil inlet 122 of the back pressure oil cavity, and the pump body assembly further includes a lower flange 200. A lower flange oil passage structure 210 is provided on a lateral surface of the lower flange 200 facing towards the back pressure oil cavity 120. The radial oil hole 140 communicates with the oil inlet 122 of the back pressure oil cavity through the lower flange oil passage structure 210, and the lower flange oil passage structure 210 is a part of the oil passage. In this way, the lubrication medium enters the radial oil hole 140 from the central oil hole 130, enters the oil passage structure 210 of the lower flange from the radial oil hole 140, and finally enters the back pressure oil cavity 120. Wherein, since the position of the radial oil hole 140 is lower than that of the oil inlet 122 of the back pressure oil cavity, it is possible to better ensure that the lubrication medium entering the back pressure oil cavity 120 gradually fills up the back pressure oil cavity 120 upwards, so that the back pressure oil cavity 120 always maintains a filled-up state, thereby further providing sufficient back pressure for the sliding vane 150 to ensure that the head of the sliding vane 150 is always closely attached to the inner wall of the bearing cylinder 400.

Figure 11:
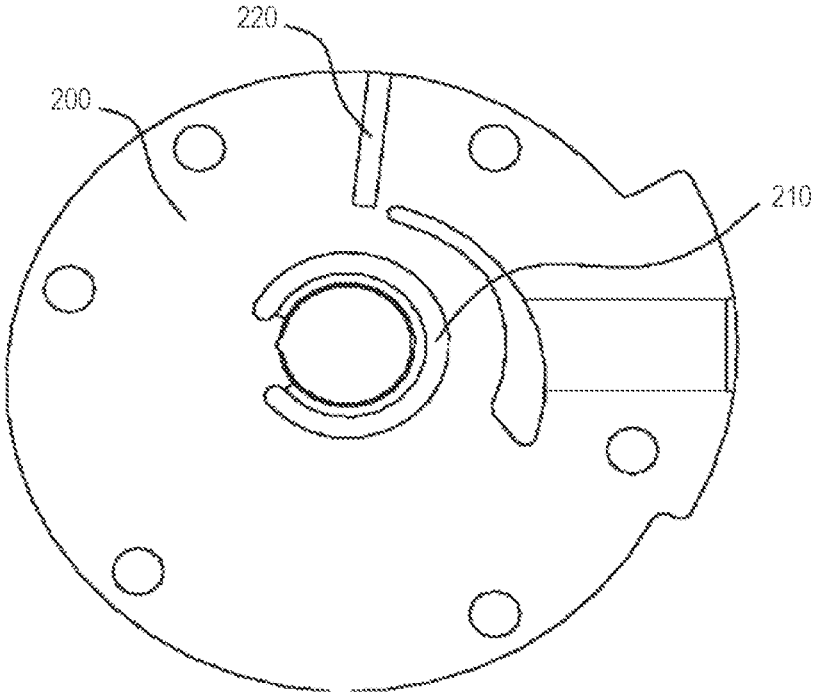
FIG. 11 shows a schematic structural view of the lower flange in FIG. 1.
Figure 12:
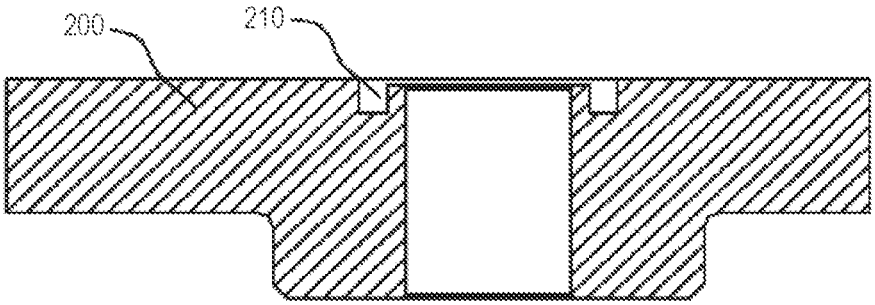
FIG. 12 shows a cross-sectional view of the lower flange in FIG. 11.

As shown in FIGS. 11 and 12, the lower flange oil passage structure 210 is a back pressure oil chute of the lower flange provided on the lower flange 200, and the back pressure oil chute of the lower flange is a stepped chute which is deeper along a direction remote from the spindle 100. The back pressure oil chute of the lower flange is designed into a stepped chute, so that it is possible to better ensure a reliable and consist flow of the lubrication medium, which is favorable for providing sufficient back pressure for the sliding vane 150, thereby improving the stability and reliability of the pump body assembly.

As shown in FIGS. 11 and 12, the projection of the stepped chute on the lower flange 200 consists in two arc structures, wherein an arc structure remote from the spindle 100 in the two arc structures is aligned with the back pressure oil cavity 120. Since the arc structure remote from the spindle 100 in the two arc structures is aligned with the back pressure oil cavity 120, during the operation process of the pump body assembly, the lubrication medium flows into the back pressure oil cavity 120 from the arc structure remote from the spindle 100.

Figure 9:
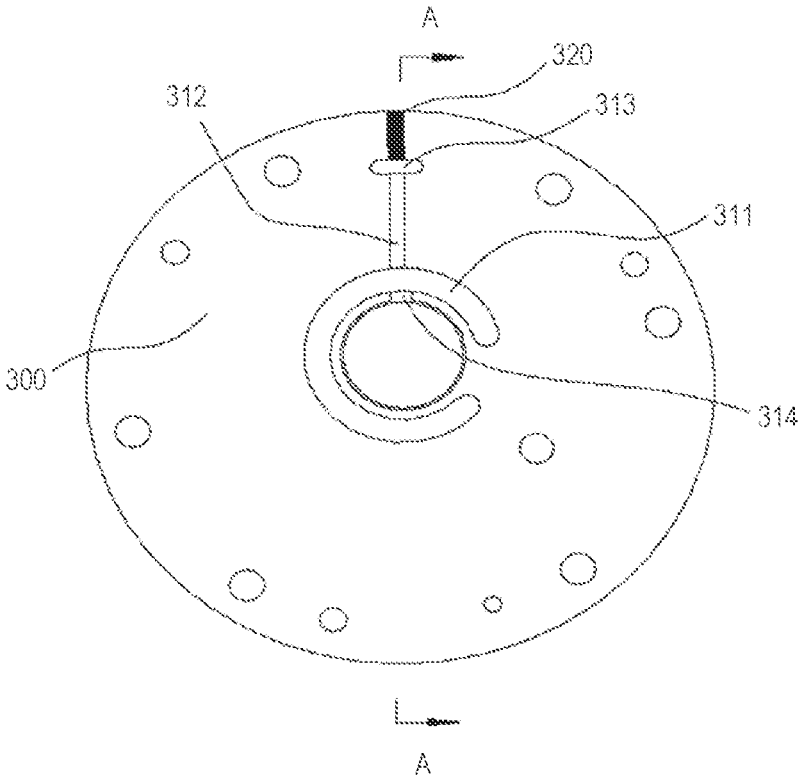
FIG. 9 shows a schematic structural view of the upper flange in FIG. 1.
Figure 10:
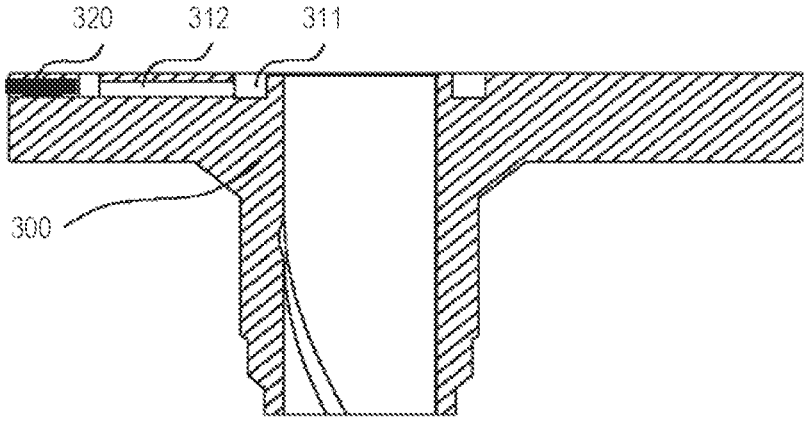
FIG. 10 shows a cross-sectional view along the direction of A-A in FIG. 9.

As shown in FIGS. 9 and 10, the pump body assembly further includes an upper flange 300 and a bearing cylinder 400. An oil passage structure 310 of the upper flange is provided on a lateral surface of the upper flange 300 facing towards the back pressure oil cavity 120. The bearing cylinder 400 has a roller accommodating cavity 410 and a roller 420 arranged within the roller accommodating cavity 410. The oil outlet 121 of the back pressure oil cavity communicates with the roller accommodating cavity 410 through the oil passage structure 310 of the upper flange, and the oil passage structure 310 of the upper flange and the roller accommodating cavity 410 are a part of the oil passage. The lubrication medium enters the oil passage structure 310 of the upper flange from the oil outlet 121 of the back pressure oil cavity and then flows into the roller accommodating cavity 410, which reduces a favorable lubricating effect on the oil passage structure 310 of the upper flange and the roller accommodating cavity 410, and at the same time takes away the heat produced by each structure, which is favorable for improving the reliability and stability of the pump body assembly.

As shown in FIGS. 1 and 2, the oil passage structure 310 of the upper flange comprises a back pressure oil chute 311 of the upper flange and a radial oil passage hole 312 opened along a radial direction of the upper flange 300. The back pressure oil chute 311 of the upper flange communicates with the oil outlet 121 of the back pressure oil cavity. At least a part of the radial oil passage hole 312 communicates with the back pressure oil chute 311 of the upper flange. The communication hole 313 and the roller accommodating cavity 410 communicate with the radial oil passage hole 312 through the communication hole 313. In this way, the lubrication structure enters the back pressure oil chute 311 of the upper flange from the oil outlet 121 of the back pressure oil cavity, enters the radial oil passage hole 312 from the back pressure oil chute 311 of the upper flange, and then enters the accommodating cavity 410 through the communication hole 313. During this process, the lubrication medium produces a favorable lubricating effect on the structure flowing therethrough, and at the same time, it is possible to take away the heat produced by each structure, which is favorable for improving the reliability and stability of the pump body assembly. In addition, since the position of the radial oil passage hole 312 is located above the back pressure oil cavity 120, it is possible to ensure that the lubrication medium within the back pressure oil cavity 120 is filled up before entering the radial oil passage hole 312.

It should be noted that one end of the radial oil passage hole 312 remote from the spindle 100 is blocked in a manner using a blind solder 320, which is machined conveniently and fast. Of course, it is also possible to block in a manner using welding or screws for example.

As shown in FIG. 9, the projection of the back pressure oil chute 311 of the upper flange on the upper flange 300 consists in an arc structure. The back pressure oil chute 311 of the upper flange uses an arc structure to align with the back pressure oil cavity 120 so as to ensure that the lubrication medium within the back pressure oil cavity 120 smoothly flows into the upper flange 300 to improve the lubricating performance of the upper flange 300 and take away the heat produced by each component, thereby better ensuring the reliability and stability of the pump body assembly.

As shown in FIGS. 1 and 2, the oil passage structure 310 of the upper flange comprises an oil distribution chute 314 through which the back pressure oil chute 311 of the upper flange communicates with the inner wall of the upper flange 300. There is a gap 330 between the inner wall of the upper flange 300 and the spindle 100, such that the lubrication medium flows into the gap through the back pressure oil chute 311 of the upper flange and the oil distribution chute 314. The lubrication medium which enters the gap between the inner wall of the upper flange 300 and the spindle 100, produces a lubricating effect on the spindle 100 and the upper flange 300, so as to reduce the friction between the spindle 100 and the upper flange 300, and reduce the mechanical power consumption here, thereby better protecting the spindle 100 and the upper flange 300, and at the same time improving the reliability and stability of the pump body assembly.

Alternatively, the ratio of the cross-sectional area of the oil distribution chute 314 to the radial oil passage hole 312 is less than or equal to 1. In this way, it is possible to ensure that there is a reduced on-way loss of the lubrication medium during the flow process of the oil passage, and that the operation of the pump body assembly is more reliable with a better operation effect, in conjunction with the length of the oil passage and the size of the pipe diameter as well as the demand of each structure for the lubrication medium.

Preferably, the ratio of the cross-sectional area of the oil distribution chute 314 to the radial oil passage hole 312 is 3:7. In this way, most of the oil flows out from the radial oil passage hole 312 to ensure sufficient lubrication and heat dissipation of the bearing cylinder 400, and sufficient lubrication medium to the spindle 100, so that the pump body assembly operate in a most reliable manner with an optimum operation effect.

As shown in FIGS. 1 and 2, the pump body assembly further includes a lower flange 200. An oil outlet chute 220 is provided on a lateral surface of the lower flange 200 facing towards the back pressure oil cavity 120. The bottom of the roller accommodating cavity 410 communicates with the oil outlet chute 220, and the oil outlet chute 220 extends to an edge of the lower flange 200. The oil outlet chute 220 is a part of the oil passage. In this way, the lubrication medium enters the oil outlet chute 220 from the bottom of the roller accommodating cavity 410 and flows back to the oil sump from the oil outlet chute 220 to realize the circulation of the lubrication medium. Through a continuous circulation process, each structure is fully lubricated and the heat produced is taken away, so as to ensure the reliability and stability of the pump body assembly.

In the present embodiments, the final oil outlet of the oil passage is provided on the lower flange 200. This is because the circulation of the lubrication medium in the oil passage produces an on-way pressure loss. If the oil outlet is exposed in the high-pressure gas within the compressor cavity, when there is pressure fluctuation within the compressor cavity, the phenomenon of gas channeling is likely to occur, which is not favorable for the lubrication medium to fill up the back pressure oil cavity 120. In the present disclosure, the oil outlet is provided on the lower flange 200 at a lower position, so that even when there is a low oil level within the compressor cavity, it is also possible to ensure that the oil outlet is below the liquid level, so as to avoid the risk of high-pressure gas channeling. The overall oil passage design ensures that the initial oil inlet has an area larger than that of the final oil outlet, thereby realizing more inflow and less outflow, and further ensuring that the back pressure oil cavity 120 is filled up with oil.

Embodiments of the Second Group

The difference from the first embodiment is that the structure of the lower flange 200 is different.

Figure 13:
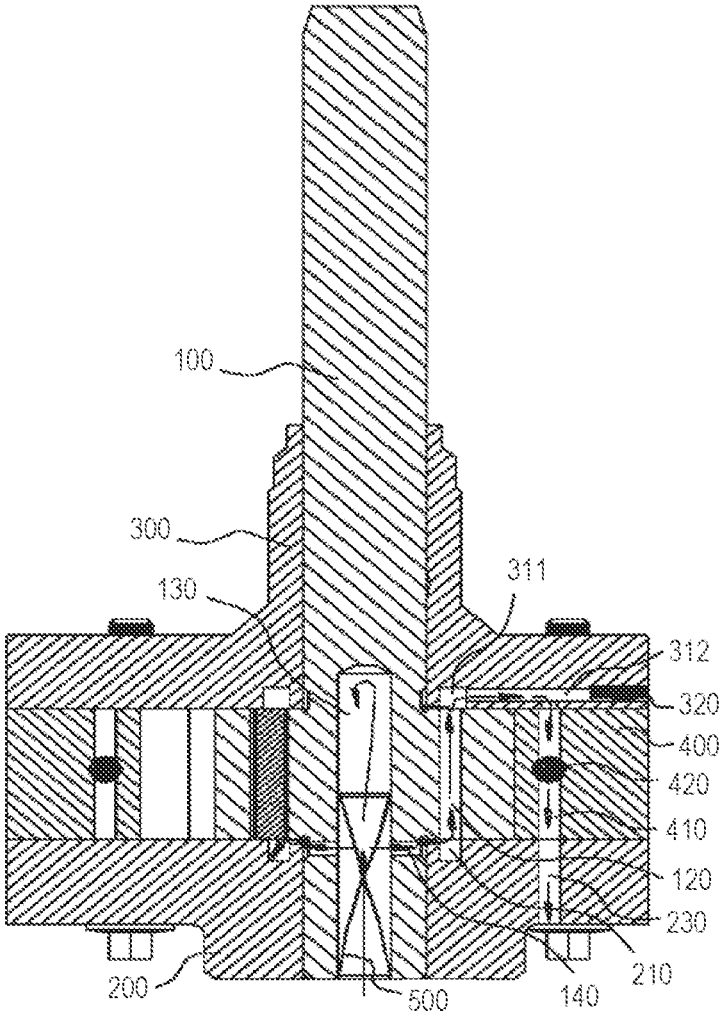
FIG. 13 shows a cross-sectional view of a pump body assembly according to some alternative embodiments of the present disclosure.

As shown in FIG. 13, the pump body assembly further comprises a lower flange 200 having an axially penetrating oil drain hole 230. The bottom of the roller accommodating cavity 410 communicates with the top of the oil drain hole 230, and the oil drain hole 230 is a part of the oil passage. In this way, the lubrication medium enters the oil drain hole 230 from the bottom of the roller accommodating cavity 410, and flows back to the oil sump from the oil drain hole 230 to realize the circulation of the lubrication medium. By a continuous circulation process, each structure is fully lubricated, and the heat produced is taken away, so as to ensure the reliability and stability of the pump body assembly.

Embodiments of the Third Group

The difference from the first embodiment is that the structure of the lower flange 200 is different.

Figure 14:
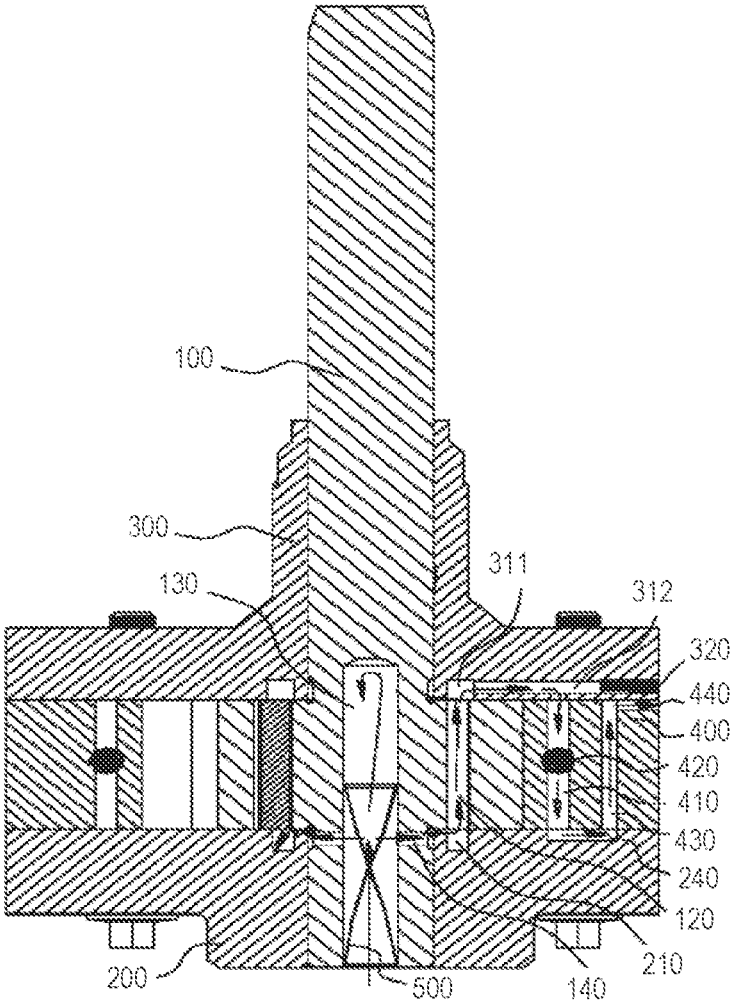
FIG. 14 shows a cross-sectional view of a pump body assembly according to some alternative embodiments of the present disclosure.

As shown in FIG. 14, the pump body assembly further includes a lower flange 200. An oil drain communication chute 240 is provided on a lateral surface of the lower flange 200 facing towards the back pressure oil cavity 120. The bearing cylinder 400 comprises: an axial oil drain channel 430, wherein the bottom of the roller accommodating cavity 410 communicates with the bottom of the axial oil drain channel 430 through the oil drain communication chute 240; a radial oil drain channel 440, wherein the top of the axial oil drain channel 430 communicates with an outer circumferential surface of the bearing cylinder 400 through the radial oil drain channel 440, and the axial oil drain passage 430 and the radial oil drain passage 440 are part of the oil passage. In this way, the lubrication medium enters the oil drain communication chute 240 from the bottom of the roller accommodating cavity 410, flows into the axial oil drain passage 430 from the oil drain communication chute 240, and finally flows back to the oil sump from the radial oil drain passage 440 so as to achieve the circulation of the lubrication medium. By a continuous circulation process, each structure is fully lubricated, and the heat produced is taken away, so as to ensure the reliability and stability of the pump body assembly during operation.

In the present embodiment, the oil passage within the bearing cylinder 400 is U-shaped.

From the above description, it is seen that the above-described embodiments of the present disclosure achieve the following technical effects:

1), since the back pressure oil cavity at the tail end of the sliding vane chute is filled up with lubrication medium, it is possible to provide sufficient back pressure for the sliding vane within the sliding vane chute so as to ensure that the head of the sliding vane is always closely attached to the inner wall of the bearing cylinder, reduce the leakage problem of the head of the sliding vane, and avoid the risk that the sliding vane is easily retracted and disengaged from the inner wall of the cylinder, which is favorable for improving the performance of the compressor;

2) it is possible to effectively avoid that the head of the sliding vane is disengaged from the bearing cylinder, which causes repeated collisions between the sliding vane and the bearing cylinder and increases the noise and vibration of the pump body assembly, thereby affecting the reliability of the sliding vane and the pump body assembly;

3) it is possible to solve the problem of lubrication and heat dissipation of the bearing cylinder, improve the reliability of the bearing cylinder, reduce the suction heating caused by the bearing cylinder, and enhance the performance of the compressor;

4) the lubrication medium produces a favorable lubricating effect on the sliding vane chute, and fully takes away the heat produced by each component, which is favorable for improving the stability of the pump body assembly;

5) the parts of the compressor are easily machined and assembled, which improves the noise and vibration of the compressor, and improves the overall energy efficiency and reliability of the compressor.

The above-described embodiments are merely part of the embodiments of the present disclosure, rather than all the embodiments. On the basis of the embodiments of the present disclosure, all the other embodiments acquired by those skilled in the art on the premise that no inventive effort is involved should fall into the protection scope of the present disclosure.

It is to be noted that the terms used here are only for the purpose of describing particular embodiments, and are not intended to limit the exemplary embodiments according to the present application. As used here, the singular forms are also intended to include plural forms unless otherwise specified additionally in the context. In addition, it should also be understood that when the term "contains" and/or "comprises" is used in the present specification, it is intended to indicate the presence of features, steps, operations, devices, assemblies, and/or combinations thereof.

It should be noted that the terms "first", "second" and the like in the specification and claims of the present application and the above-described accompanying drawings are used to distinguish similar objects, and are not necessarily used to describe a specific order or sequence. It is to be understood that the data thus used is interchangeable as appropriate, such that the embodiments of the present application described here are implemented in a sequence other than those illustrated or described here.

The foregoing descriptions are only preferred embodiments of the present disclosure, but do not serve to limit the present disclosure. For those skilled in the art, various modifications and changes are made in the present disclosure. Any amendment, equivalent replacement, improvement, and the like made within the spirit and principles of the present disclosure should all be contained within the protection scope of the present disclosure.

What is claimed is:

1. A pump body assembly, comprising:

a spindle, wherein the spindle has a sliding vane chute, a back pressure oil cavity being at least a part of an oil passage is located at a tail end of the sliding vane chute, an oil outlet of the back pressure oil cavity is located at a top of the back pressure oil cavity, and a position of an oil inlet of the back pressure oil cavity is lower than that of the oil outlet of the back pressure oil cavity such that a lubrication medium enters the back pressure oil cavity through the oil inlet of the back pressure oil cavity and fills up the back pressure oil cavity and flows out from the top of the back pressure oil cavity;

wherein the pump body assembly further comprises:

an upper flange, wherein an oil passage structure of the upper flange is provided on a lateral surface of the upper flange facing towards the back pressure oil cavity; and a bearing cylinder, having a roller accommodating cavity and a roller command within the roller accommodating cavity, the oil outlet of the back pressure oil cavity communicates with the roller accommodating cavity through the oil passage structure of the upper flange, and the oil passage structure of the upper flange and the roller accommodating cavity are a part of the oil passage;

wherein the oil passage structure of the upper flange comprises:

a back pressure oil chute of the upper flange communicating with the oil outlet of the back pressure oil cavity;

a radial oil passage hole extending along a radial direction of the upper flange, wherein at least a part of the radial oil passage hole communicates with the back pressure oil chute of the upper flange; and a communication hole, through which the roller accommodating cavity communicates with the radial oil passage hole;

wherein the oil passage structure of the upper flange comprises an oil distribution chute, wherein the back pressure oil chute of the upper flange communicates with an inner wall of the upper flange through the oil distribution chute, and there is a gap between the inner wall of the upper flange and the spindle, such that the lubrication medium flows into the gap through the back pressure oil chute of the upper flange and the oil distribution chute;

wherein a ratio of a cross-sectional area of the oil distribution chute to that of the radial oil passage hole is 3:7.

2. The pump body assembly according to claim 1, wherein the spindle has a central oil hole extending upward from a bottom and a radial oil hole (140) communicating with the central oil hole, the central oil hole and the radial oil hole constitute a part of the oil passage, and the lubrication medium flows to the back pressure oil cavity through the central oil hole and the radial oil hole.

3. The pump body assembly according to claim 2, wherein a position of the radial oil hole is lower than that of the oil inlet of the back pressure oil cavity, and the pump body assembly also comprises a lower flange, an oil passage structure of the lower flange is provided on a lateral surface of the lower flange facing towards the back pressure oil cavity, the radial oil hole communicates with the oil inlet of the back pressure oil cavity through the oil passage structure of the lower flange, and the oil passage structure of the lower flange is a part of the oil passage.

4. The pump body assembly according to claim 3, wherein the oil passage structure of the lower flange is a back pressure oil chute of the lower flange provided on the lower flange, wherein the back pressure oil chute of the lower flange is a stepped chute which is deeper along a direction far away from the spindle.

5. The pump body assembly according to claim 4, wherein a projection of the stepped chute on the lower flange is a plurality of arc profiles and a first arc profile furthest away from the spindle in the plurality of arc profiles is aligned with the back pressure oil cavity.

6. The pump body assembly according to claim 1, wherein a projection of the back pressure oil chute of the upper flange on the upper flange is an arc profile.

7. The pump body assembly according to claim 1, wherein the pump body assembly further comprises a lower flange, wherein an oil outlet chute is provided on a lateral surface of the lower flange facing towards the back pressure oil cavity, a bottom of the roller accommodating cavity communicates with the oil outlet chute, and the oil outlet chute extends to an edge of the lower flange, wherein the oil outlet chute is a part of the oil passage.

8. The pump body assembly according to claim 1, wherein the pump body assembly further comprises a lower flange having an axially penetrating oil drain hole, wherein the bottom of the roller accommodating cavity communicates with a top of the oil drain hole, and the oil drain hole is a part of the oil passage.

9. The pump body assembly according to claim 1, wherein the pump body assembly further comprises a lower flange, wherein an oil drain communication chute is provided on a lateral surface of the lower flange facing towards the back pressure oil cavity; the bearing cylinder comprises:

an axial oil drain channel, wherein the bottom of the roller accommodating cavity communicates with the bottom of the axial oil drain channel through the oil drain communication chute; and a radial oil drain passage, wherein the top of the axial oil drain passage communicates with an outer circumferential surface of the bearing cylinder through the radial oil drain passage, and the axial oil drain passage and the radial oil drain passage are part of the oil passage.

10. A compressor, comprising the pump body assembly according to claim 1.

* * * * *